US005646518A

United States Patent [19]

Lakshmikumar et al.

[11] Patent Number: 5,646,518

[45] Date of Patent: Jul. 8, 1997

[54] PTAT CURRENT SOURCE

[75] Inventors: Kadaba R. Lakshmikumar, Wescosville, Pa.; Krishnaswamy Nagaraj, Somerville, N.J.; David Arthur Rich, Woodmere, N.Y.; Khong-Meng Tham, Reading, Pa.

[73] Assignee: Lucent Technologies Inc., Murray Hill, N.J.

[21] Appl. No.: 342,188

[22] Filed: Nov. 18, 1994

[51] Int. Cl.[6] ..... G05F 3/16

[52] U.S. Cl. ..... 323/316; 323/907; 330/257

[58] Field of Search ..... 323/316, 907; 330/257, 253; 327/327

[56] References Cited

U.S. PATENT DOCUMENTS

| | | | |
|---|---|---|---|
| 4,327,320 | 4/1982 | Oguey et al. | 323/313 |
| 4,399,399 | 8/1983 | Joseph | 323/315 |
| 4,554,515 | 11/1985 | Burson et al. | 330/261 |
| 4,593,208 | 6/1986 | Single | 307/296 R |
| 4,839,535 | 6/1989 | Miller | 307/296.7 |
| 4,849,684 | 7/1989 | Sonntag et al. | 323/313 |
| 5,038,053 | 8/1991 | Djenguerian et al. | 307/310 |
| 5,061,862 | 10/1991 | Tamagawa | 307/296.1 |
| 5,081,410 | 1/1992 | Wood | 323/316 |
| 5,168,210 | 12/1992 | Thus | 323/313 |
| 5,245,273 | 9/1993 | Greaves et al. | 323/313 |
| 5,307,007 | 4/1994 | Wu et al. | 323/313 |
| 5,309,083 | 5/1994 | Pierret et al. | 323/313 |
| 5,352,973 | 10/1994 | Audy | 323/313 |
| 5,391,980 | 2/1995 | Thiel et al. | 323/314 |
| 5,448,158 | 9/1995 | Ryat. | 323/315 |
| 5,506,543 | 4/1996 | Yung | 330/253 |

FOREIGN PATENT DOCUMENTS

| | | | |
|---|---|---|---|
| 0 350 875 | 1/1990 | European Pat. Off. | G05F 3/20 |
| 0 483 913 | 5/1992 | European Pat. Off. | G05F 3/30 |
| WOA8302342 | 7/1983 | WIPO | G05F 1/56 |

OTHER PUBLICATIONS

IEEE Journal Of Solid–State Circuits, vol. 30, No. 5, May 1995, pp. 586–590, XP 000510257, K–M Tham et al, "A Low Supply Voltage High PSRR Voltage REference In CMOS Process."

IEEE Journal Of Solid–State Circuits, vol. 28, No. 6, 1 Jun. 1993, pp. 667–670, XP 000378425, Made Gunawan et al, "A Curvature–Corrected Low–Voltage Bandgap Reference."

"Bandgap Voltage Reference Generator," application for United States Letters Patent, by Krishnaswamy Nagaraj, 20 pages, Serial No. 08/175076, filed Dec. 29, 1993. US Patent 5,512,817, Apr. 96, Nagaraj.

*Primary Examiner*—Peter S. Wong
*Assistant Examiner*—Shawn Riley

[57] ABSTRACT

Briefly, in accordance with one embodiment of the invention, a current source comprises: a first and a second current path, the current paths being coupled so as to provide, during circuit operation, first and second currents through the respective current paths in a substantially predetermined direct proportion. The current source further includes an operational amplifier having its respective input terminals coupled to the first and second current paths, the operational amplifier being coupled in a feedback configuration so as to maintain substantially equal voltages between a first and second predetermined point respectively located along the first and second current paths. Furthermore, the respective first and second currents are related to the respective first and second voltages substantially in accordance with the junction diode equation.

16 Claims, 6 Drawing Sheets

PTAT CURRENT SOURCE

CROSS-REFERENCE TO RELATED APPLICATION

This patent application is related to patent application Ser. No.: 08/175076, entitled "Bandgap Voltage Reference Generator," by Nagaraj, filed Dec. 29, 1993, assigned to the assignee of the present invention and herein incorporated by reference.

TECHNICAL FIELD

The present invention relates to current sources and, more particularly, to a current source capable of producing a current substantially proportional to absolute temperature (PTAT).

BACKGROUND OF THE INVENTION

The use of portable battery operated equipment or systems that employ complex high performance electronic circuitry has increased recently with the widespread use of, for example, cellular telephones, laptop computers, and other systems. In such systems, it has become important to provide a voltage reference. Likewise, in such a system, it is desirable for this voltage reference to operate at a relatively low power supply voltage, such as on the order of 3 volts, and it is desirable that the voltage reference be stable and substantially immune to temperature variations, power supply variations, and noise.

Typically, a circuit known as a bandgap voltage reference generator is employed to provide the desired stable reference or bandgap voltage. One such bandgap voltage reference generator is described in U.S. Pat. No. 4,849,684, entitled "CMOS Bandgap Voltage Reference Apparatus and Method," by Sonntag et at., issued Jul. 18, 1989, assigned to the assignee of the present invention and herein incorporated by reference. Such a bandgap reference is particularly useful for a variety of applications; however, typically the bandgap voltage reference described in the aforementioned patent requires a power supply on the order of about 4 volts to produce a voltage reference or bandgap voltage reference of about 1.25 volts. Other bandgap voltage reference generators are also described elsewhere, such as the bandgap voltage reference generator described on pages 295–296 of *Analysis and Design of Analog Integrated Circuits,* by P. Gray and R. Meyer, 2d. Ed., available from John Wiley & Sons, and shown in FIG. 4.30*c* of that publication, herein incorporated by reference. Such a bandgap has disadvantages including the fact that the bipolar transistors in the circuit may not be realized in a standard MOS integrated circuit fabrication process because the collectors must be floating. Likewise, instead of producing a bandgap voltage reference that is substantially independent of temperature, it may be desirable, in some circumstances, instead to have a current source that produces a current substantially proportional to absolute temperature. Such a current source may be employed to provide a bandgap voltage reference, while also providing greater flexibility with respect to alternate applications. Unfortunately, prior art bandgap voltage reference generators typically do not provide a PTAT current in a manner so that the current is available for circuitry external to the generator. Thus, a need exists for a current source that is capable of providing a current substantially proportional to absolute temperature that will operate satisfactorily with a relatively low voltage power supply, such as below 4 volts.

SUMMARY OF THE INVENTION

Briefly, in accordance with one embodiment of the invention, a current source comprises: a first and a second current path, the current paths being coupled so as to provide, during circuit operation, first and second currents through the respective current paths in a substantially predetermined direct proportion. The current source further includes an operational amplifier having its respective input terminals coupled to the first and second current paths, the operational amplifier being coupled in a feedback configuration so as to maintain substantially equal voltages between a first and second predetermined point respectively located along the first and second current paths. Furthermore, the respective first and second currents are related to the respective first and second voltages substantially in accordance with the junction diode equation.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects and advantages thereof, may best be understood by reference to the following detailed description when read with the accompanying drawings in which:

DETAILED DESCRIPTION

Figure 1:
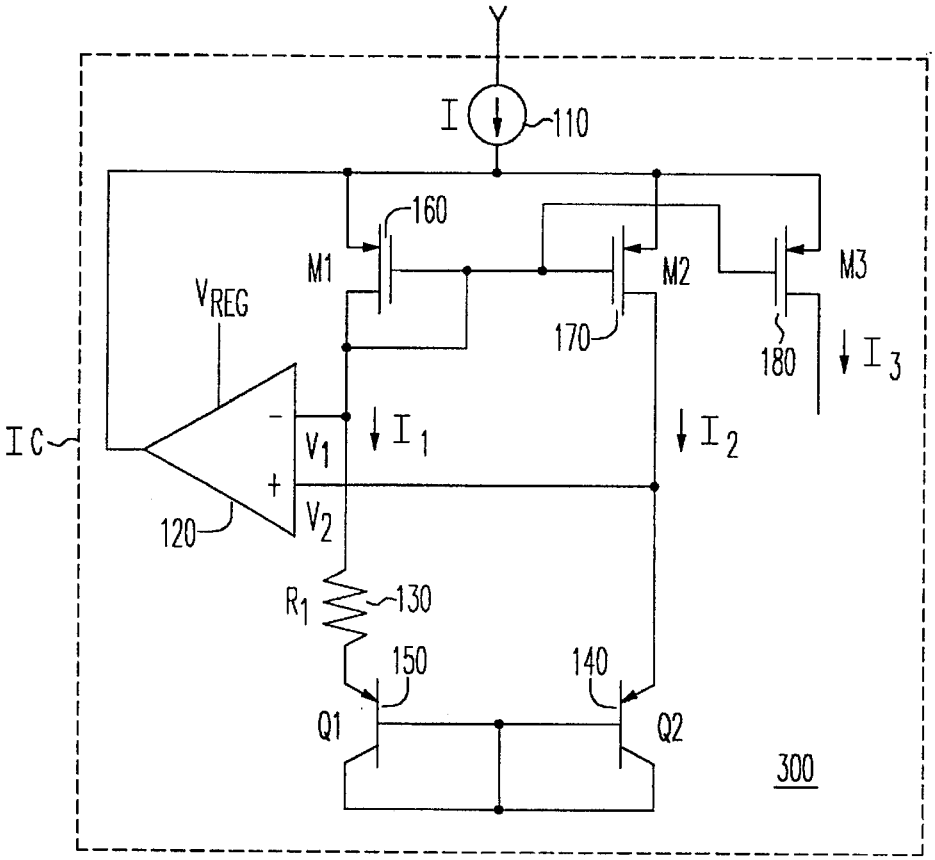
FIG. 1 is a circuit diagram illustrating one embodiment of a PTAT current source in accordance with the invention.

FIG. 1 is a circuit diagram illustrating an embodiment 300 of a current source capable of producing a current substantially proportional to absolute temperature (PTAT) in accordance with the invention, that is, a PTAT current source in accordance with the invention. Although FIG. 1 depicts embodiment 300 as embodied on an integrated circuit (IC), the invention is not limited in scope in this respect. As illustrated, current source 110 comprises a conventional current source that supplies current to the remaining portion of circuit 300. Current source 110 may be realized, for example, as a current mirror coupled to a voltage source, such as $V_{DD}$, as a power supply, although the scope of the invention is not limited in this respect. Furthermore, although current source 110 is illustrated on the IC, it may alternatively comprise an external current source. Excess current provided by current source 110, but not utilized by circuit components 140, 150, 160, 170, and 180, illustrated in FIG. 1, may flow into operational amplifier 120. In this context, the term operational amplifier refers to a device that directly compares two voltage levels or voltage signals, such as, for example, comparing the voltage across both load element 130 and transistor 150 with the voltage across transistor 140, and provides an amplified output voltage signal response based at least in part on that voltage signal comparison.

As illustrated in FIG. 1, MOS devices 160 and 170 are coupled so as to provide a current mirror. Thus, as illustrated, a first current, $I_1$, flows in or through a first current path, and a second current, 12, flows in or through a second current path. The ratio of the first current to the second current is established substantially by the current mirror formed by devices 160 and 170. Because MOS device 160 is "diode connected" in this particular embodiment, i.e., has its drain electrically connected to its gate, when a positive voltage is applied to the gate of MOS device 160 the device operates in its saturation region. Likewise, as will be explained in more detail hereinafter, feedback provided by operational amplifier 120 ensures that the drain-to-source voltage of MOS device 170 is substantially equal to the drain-to-source voltage of MOS device 160. Thus, MOS device 170 should also be operating in its saturation region of operation during circuit operation. Likewise, although the invention is not restricted in scope in this respect, operational amplifier 120 may be coupled to a low voltage power supply, $V_{REG}$, such as around or below 2 volts, as explained in more detail hereinafter. Despite the advantages associated with employing a low voltage power supply, nonetheless, the power supply for operational amplifier 120 should provide sufficient power so that operational amplifier 120 may provide sufficient feedback to circuit 300 so that components 180, 160 and 170 are operating in their saturation region and components 140 and 150 are operating in their active region during circuit operation over a range of operating conditions.

As is well-known, where MOS devices 160 and 170 are coupled so as to form a current mirror, as illustrated in FIG. 1, the ratio of the first current, $I_1$, to the second current, $I_2$, is provided by the following equation:

$$I_1/I_2 = \frac{(W_1/L_1)}{(W_2/L_2)} \quad [1]$$

where $W_n$, $L_n$ for n=1, 2 are the respective widths and lengths of the gates of the respective MOS devices 160 and 170 provided in appropriate units.

As illustrated in FIG. 1, in this particular embodiment bipolar transistors 150 and 140 are respectively coupled to the first current path and the second current path. Thus, the first current and the second current flowing through the first current path and the second current path are related to a first voltage and a second voltage at respective predetermined points located along the first current path and the second current path substantially in accordance with the junction diode equation. Of course, the first and second voltages are determined relative to an absolute voltage level, such as ground. As will be explained in more detail hereinafter, a number of advantages are provided by ensuring that this relationship between the currents and voltages in the first and second current paths substantially applies. Nonetheless, the invention is not limited in scope to the use of PNP or NPN bipolar transistors. For example, alternatively diodes may be employed. Likewise, an MOS device being operated in its subthreshold region may alternatively be employed. Thus, in this context, the term semiconductor device refers to a device comprising semiconductor material that includes a semiconductor junction in which, for the device, the relationship between the current through the device and the voltage across the device, or any portion thereof, may be substantially in accordance with the junction diode equation. For example, as another alternative, two darlington pair configurations may be employed, each in place of one of transistors 150 and 140. In this context, the junction diode equation refers to the following fundamental relationship or its equivalent:

$$I = I_O(e^{V/nV_T} - 1) \quad [2]$$

where I is the device current, V is the device voltage, $I_O$ is the reverse saturation current, $V_T$ is the thermal voltage, and n is a constant related to properties of the semiconductor material employed and other factors.

As illustrated in FIG. 1, due to the feedback of operational amplifier 120, the voltage across load element 130, in this particular embodiment a resistor, is dependent, at least in part, on the difference between the base-to-emitter voltage for bipolar transistor 150 and the base-to-emitter voltage for bipolar transistor 140. This occurs because the feedback of operational amplifier 120 essentially maintains circuit operation so that the series voltage across both load element 130 and the base-to-emitter voltage of transistor 150 is substantially equal to the base-to-emitter voltage across transistor 140. Likewise, due to the mutual coupling of the bases and collectors of bipolar transistors 140 and 150, these transistors are operating in their active regions during circuit operation. More specifically, the base-to-collector voltage for these transistors is essentially zero. Likewise, if the emitter area of transistor 150 is $A_1$ and the emitter area of transistor 140 is $A_2$ then the voltage across load element 130 may be represented by the following equation:

$$\Delta V_{BE} = V_T \ln \frac{I_{c2}A_1}{I_{c1}A_2} \quad [3]$$

where $V_T$ is the "thermal voltage" defined below and $I_{c1}$, $I_{c2}$ are the collector currents of transistors 150 and 140, respectively. Likewise, as illustrated in equation [3] above, the process parameters $I_o$ and n that typically appear in the junction diode equation essentially cancel for a PTAT current source in accordance with the invention due, in this particular embodiment, to the relationship between bipolar transistors 140 and 150 in circuit 300. The first current, $I_1$, may then be found using equations [1] and [3] as:

$$I_1 = \frac{\Delta V_{BE}}{R_1} = \frac{V_T}{R_1} \ln \frac{(W_2/L_2)A_2}{(W_1/L_1)A_1} \quad [4]$$

where $R_1$ is the resistance associated with load element 130. Equation [4] above therefore illustrates that current $I_1$ is essentially proportional to absolute temperature (PTAT) because the term $V_T$ is the "thermal voltage," defined as kT/q, where:

k=Boltzmann's constant,

T=absolute temperature, and q=the charge on an electron.

Although load element 130 may have a resistance that changes with temperature, typically such variations are negligible in this context and may essentially be ignored. Furthermore, any significant temperature effects that may exist may be utilized in conjunction with an embodiment of a PTAT current source in accordance with the invention, as explained in more detail hereinafter. Alternative embodiments may also omit load element 130 altogether, such as described in Section 12.3 and Problem 12.13 of *Analysis and Design of Analog Integrated Circuits,* by P. Gray and R. Meyer, 2d ed., available from John Wiley & Sons, herein incorporated by reference. In this embodiment, the widths and lengths of the gates of the MOSFETs, such as MOS device 160 and MOS device 170 in FIG. 1, and the emitter area of the bipolar transistors, such as for transistors 140 and 150 in FIG. 1, may be adjusted in order to achieve a substantially predetermined desired current value for $I_i$.

The voltage across load element 130 in conjunction with the base-to-emitter voltage of bipolar transistor 150 may be substantially equal to the base-to-emitter voltage of bipolar transistor 140 for a particular value of first current $I_2$, if first current $I_1$ is substantially in direct proportion to second current $I_2$. In this particular embodiment, the condition that first current $I_1$ is in direct proportion to second current $I_2$ is established by the current mirror formed by MOS devices 160 and 170, as previously described. Likewise, in this embodiment, the magnitude of first current $I_1$ is effectively established by the voltage at the output terminal of operational amplifier 120. Thus, operational amplifier 120 is coupled in a feedback configuration so that operational amplifier 120 has an output voltage to ensure that the voltage ($V_1$) across load element 130 plus the base-to-emitter voltage of transistor 150 substantially equals the base-to-emitter voltage ($V_2$) of transistor 140. Likewise, first current, $I_1$, which provides a current substantially proportionally to absolute temperature, may be conveniently mirrored, such as by MOS device 180 in FIG. 1, to provide a third current, $I_3$. Third current, $I_3$, therefore is also substantially proportional to absolute temperature. This provides one aspect of a PTAT current source in accordance with the invention, such as the embodiment illustrated in FIG. 1. Whereas various prior art techniques for providing a bandgap voltage reference generator may involve a PTAT current in one form or another, typically such PTAT currents are not supplied in the circuit in a manner so that the current is conveniently available for use by circuitry external to the generator.

Another aspect of a PTAT current source in accordance with the invention, such as the embodiment illustrated in FIG. 1, is a relatively low voltage drop across the circuit. For example, as illustrated in FIG. 1, the voltage drop across circuit 300 comprises the voltage drop across MOS device 170 and the voltage drop across transistor 140, which in this particular embodiment is the base-to-emitter voltage of the bipolar transistor. Furthermore, for a PTAT current source in accordance with the invention, such as circuit 300 illustrated in FIG. 1, operational amplifier 120 provides feedback to ensure that a substantially predetermined voltage is applied to MOS devices 160 and 170. Likewise, the gain of this feedback control loop is relatively high, as will be explained in more detail hereinafter, so that the feedback configuration employing the operational amplifier ensures that $V_1$ and $V_2$, as previously described, are substantially equal while the operational amplifier also applies a substantially predetermined output voltage to MOS devices 160 and 170 for satisfactory operation.

Figure 2:
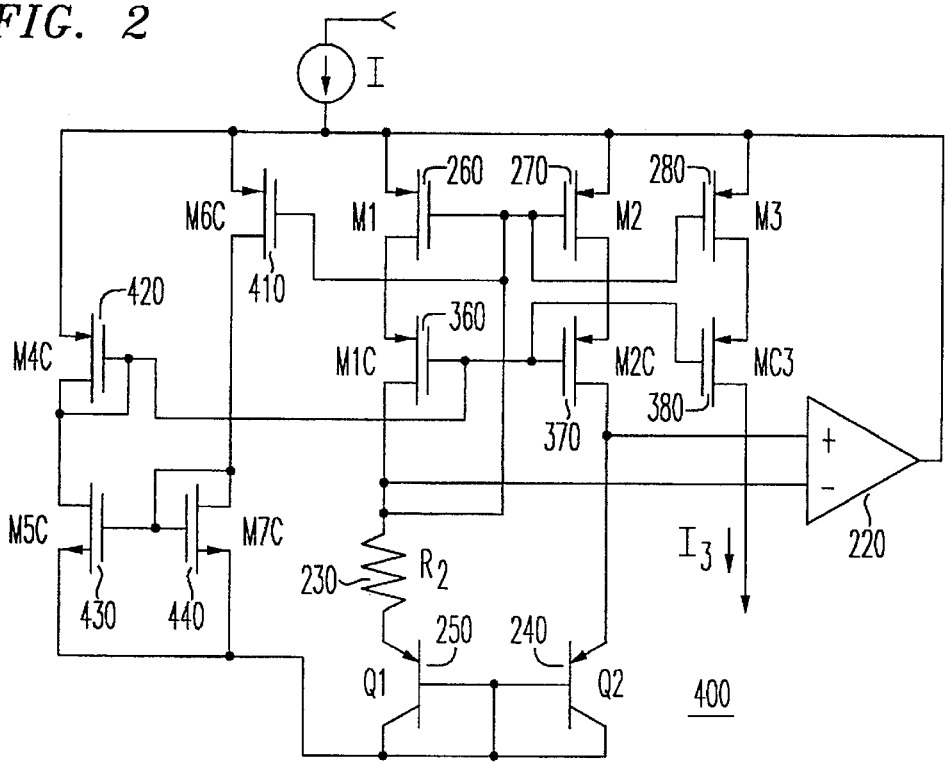
FIG. 2 is a circuit diagram illustrating another embodiment of a PTAT current source in accordance with the invention.

FIG. 2 illustrates yet another embodiment of a PTAT current source in accordance with the invention. One aspect of the embodiment illustrated in FIG. 2 is a higher output resistance in comparison with the embodiment illustrated in FIG. 1. An advantage associated with this increased output resistance is that such an embodiment of a PTAT current source in accordance with the invention more closely resembles an "ideal" current source. As illustrated in FIG. 2, circuit 400 includes an operational amplifier 220, bipolar transistors 240 and 250, a load element 230, and a current mirror formed from MOS devices 260 and 270. One difference between the embodiment illustrated in FIG. 1 includes MOS devices 360, 370 and 380 which operate as high-swing cascode devices, such as described, for example, at pages 246–47 of *Analog MOS Integrated Circuits for Signal Processing*, by Gregorian and Temes, 1986, available from John Wiley & Sons, herein incorporated by reference. Likewise, the cascode devices are biased by MOS devices 410, 420, 430 and 440. It will, of course, be appreciated that a PTAT current source in accordance with the invention is not limited in scope to a particular current mirror, such as 160 and 170 illustrated in FIG. 1. Any current mirror, such as, for example, those illustrated in FIG. 2, will provide satisfactory operation.

Figure 3:
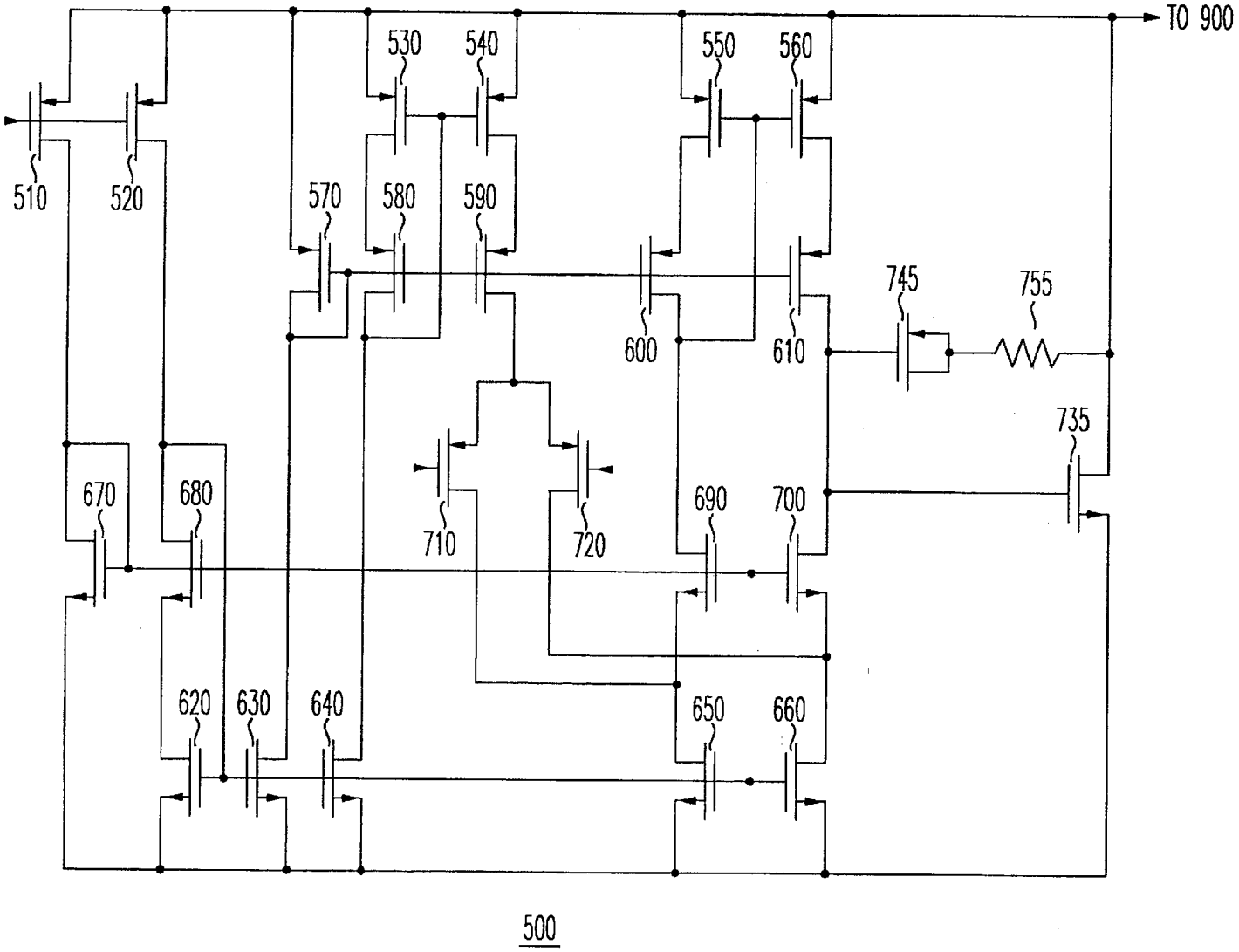
FIG. 3 is a circuit diagram of an embodiment of an operational amplifier that may be used in conjunction with a PTAT current source in accordance with the invention.

FIG. 3 illustrates a circuit diagram of an operational amplifier 500 such as may be incorporated in a PTAT current source in accordance with the invention. As will be explained in more detail hereinafter, the power supply rejection ratio (PSRR) for a PTAT current in accordance with the invention may be improved by powering the operational amplifier, such as operational amplifier 120 in FIG. 1, for example, from the same current source that is used to supply the first current in the first current path and the second current in the second current path i.e., from the regulated supply rail in this embodiment. To achieve this, an operational amplifier that can operate at low voltages is desirable because one advantage of a PTAT current source in accordance with the invention is the ability to operate at low voltages, as previously described. Nonetheless, the scope of the invention is, of course, not restricted in this respect.

One embodiment of such an operational amplifier is illustrated in FIG. 3. This operational amplifier comprises a folded cascode operational amplifier, which is well-known in the art, such as described in the aforementioned text *Analysis and Design of Analog Integrated Circuits* by P. Gray and R. Meyer, on pages 752–755, herein incorporated by reference. As illustrated in FIG. 3, the operational amplifier comprises MOS devices 550, 560, 600, 610, 710, 720, 690, 700, 650 and 660. Likewise, MOS devices 510, 520, 530, 540, 570, 580, 590, 670, 680, 620, 630 and 640 provide high swing current biases for the just described MOS devices. As illustrated in FIG. 3, the respective voltages to be compared are applied to the gates of MOS devices 710 and 720 in this particular embodiment. Likewise, MOS device 735 is the second gain stage of the operational amplifier and is "Miller compensated" by MOS device 745 and resistor 755. Miller compensation is described, for example, on pages 745–749 of the aforementioned Gray and Meyer text, herein incorporated by reference. For this particular embodiment, the operational amplifier only "pulls down" or provides feedback to reduce the amount of current supplied, such as via current source 110, for example, when operational amplifier 500 shown in FIG. 3 is incorporated in place of operational amplifier 120 for the embodiment of a PTAT current source in accordance with the invention illustrated in FIG. 1. Of course, the invention is not restricted in scope to an operational amplifier that only "pulls down." One advantage of employing a folded cascode operational amplifier in this context is that such an operational amplifier achieves relatively high gain and high bandwidth, providing improved PSRR. In this context, this provides an advantage in that any offset error associated with the comparison of the voltages performed by the operational amplifier is reduced due to the relatively high gain achieved.

Another advantage of employing an operational amplifier in a feedback configuration in a PTAT current source in accordance with the present invention is that the operational amplifier directly compares two voltages to produce a voltage response. Thus, for a PTAT current source in accordance with the invention, such as illustrated in FIG. 1, for example, essentially only one potential offset error may be introduced by this direct voltage comparison. Problems associated with offset errors may be exacerbated from offset error drift during circuit operation and from offset error variations that may be attributable to statistical variations that occur during device fabrication. Furthermore, this one offset error may be reduced to thereby provide a more "absolutely accurate" PTAT current and to reduce relative errors, such as due to fluctuations in supply voltage or temperature.

Figure 4:
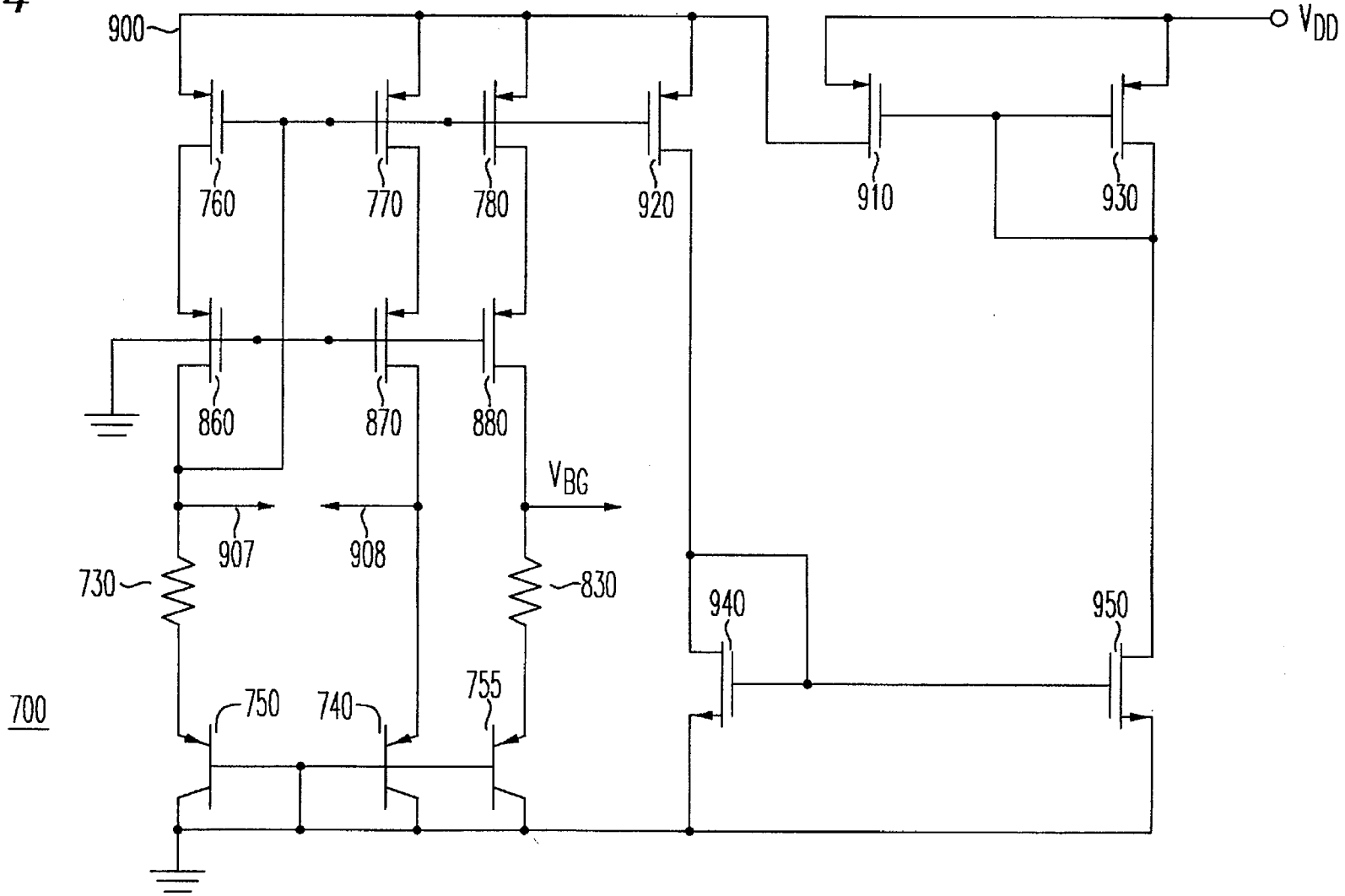
FIG. 4 is an embodiment of a bandgap voltage reference generator that includes an embodiment of a PTAT current source in accordance with the invention.

FIG. 4 illustrates an embodiment of a PTAT current source in accordance with the invention incorporated in a bandgap voltage reference generator 700. Likewise, the bandgap voltage reference generator illustrated in FIG. 4 may use embodiment 500 of an operational amplifier illustrated in FIG. 3, although the invention is, of course, not restricted in scope in this respect. Nodes 907 and 908 provide the input voltages to be applied to the gates of MOS devices 710 and 720 of the operational amplifier of FIG. 3 for this particular embodiment. Likewise, the second stage output voltage may be coupled to node 900. In this particular embodiment, the cascode devices illustrated in FIG. 2 are likewise employed; however, in this particular embodiment, MOS devices 860, 870 and 880 are biased by coupling the gates to ground so that MOS devices 410, 420, 430 and 440 shown in FIG. 2 may be eliminated for embodiment 700 illustrated in FIG. 4.

Another aspect of a PTAT current source in accordance with the invention, such as the embodiment illustrated in FIG. 4, is that the operational amplifier may be coupled so that it obtains current from the current source that also supplies current for the first and second current paths. Thus, as just described, node 900 may be coupled to the operational amplifier output voltage terminal. For example, a current source corresponding, for example, to current source 110, shown in FIG. 1, is realized in this particular embodiment by MOS device 910 in FIG. 4 coupled to $V_{DD}$. Furthermore, the current supplied to the operational amplifier is developed at least in part based on the current supplied by a PTAT current source in accordance with the invention. In this particular embodiment, the current flow through MOS device 910 is set by two current mirrors that mirror the PTAT current, such as the current provided through MOS device 920 which, for example, corresponds to MOS device 180 for the embodiment illustrated in FIG. 1. In this embodiment, the first mirror is formed from MOS device 950 and MOS device 940. The second current mirror is formed from MOS device 910 and MOS device 930. Since a PTAT current substantially independent of a supply voltage is employed to drive the current flow, an improved power supply rejection ratio (PSRR) relative to a conventional current source therefore results.

As previously suggested, FIG. 4 illustrates a PTAT current source in accordance with the invention employed as part of a bandgap voltage reference generator. The approach illustrated in FIG. 4 is a conventional approach, such as described on page 736 of the previously referenced text *Analysis and Design of Analog Integrated Circuits*, by Gray and Meyer, herein incorporated by reference. As illustrated in FIG. 4, a PTAT current, such as the current through MOS device 780, later flows through resistor 830 and bipolar transistor 755. Thus, the voltage across resistor 830 increases with temperature because the current is derived from a PTAT current source. Likewise, as is well-known, the voltage across the base-to-emitter junction of bipolar transistor 755 decreases with temperature. Thus, if resistor 830, the width-to-length ratio of the gate of transistor 755, and the amount of the PTAT current are appropriately scaled, the voltage across resistor 830 and bipolar transistor 755 together may be made to be substantially constant with temperature.

It will, of course, be appreciated that in some circumstances it may be desirable to have a voltage reference, such as a bandgap voltage reference, that is substantially proportional to absolute temperature in contrast with a voltage reference substantially independent of temperature, such as the embodiment illustrated in FIG. 4. A PTAT current source in accordance with the invention may be also employed in such voltage reference generators. Such a voltage reference generator may be useful in some circumstances to detect temperature in conjunction with a bandgap voltage reference generator providing a voltage reference substantially independent of temperature, and a conventional voltage comparator or operational amplifier, for example. Another potentially useful application of such a circuit may include compensating for changes in any bias voltages attributable to temperature changes during circuit operation. By adjusting the resistance, for example, of resistor 830, the value of the PTAT current, and the emitter size of the bipolar transistor, such as transistor 755, a voltage with an appropriate temperature coefficient may be configured. It is intended to include within the scope of the appended claims all such voltage reference circuits that include a PTAT current source in accordance with the invention.

Figure 5:
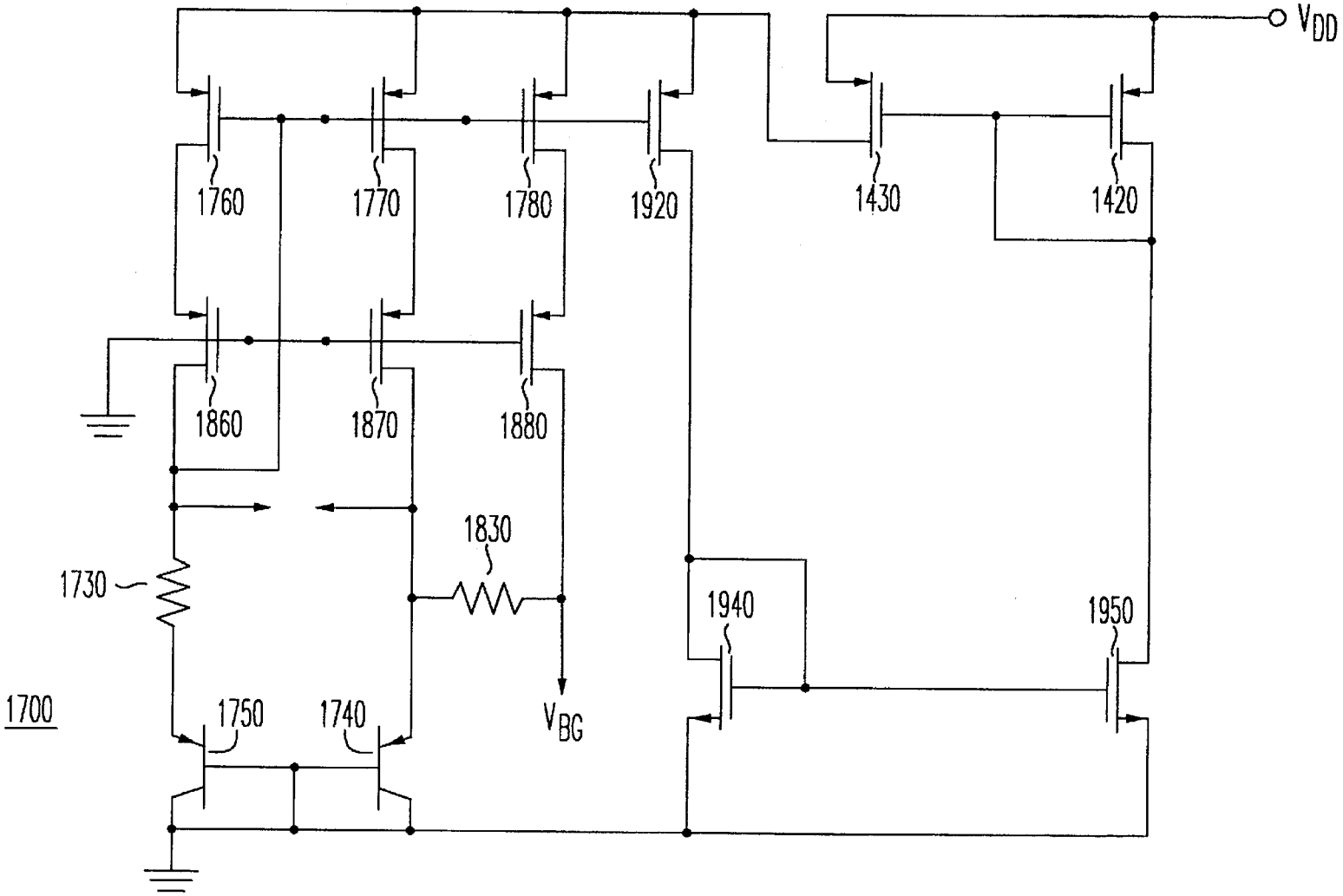
FIG. 5 is another embodiment of a bandgap voltage reference generator that includes an embodiment of a PTAT current source in accordance with the invention.

FIG. 5 illustrates yet another embodiment 1700 of a PTAT current source in accordance with the invention. Embodiment 1700 includes MOS devices 1760, 1770, 1780, 1860, 1870, 1880, 1420, 1430, 1940, and 1950, resistors 1730 and 1830 and bipolar transistors 1740 and 1750. In this particular embodiment, in comparison with the embodiment illustrated in FIG. 4, bipolar transistor 755 has been eliminated. To do this, the approach described in aforementioned U.S. Pat. No. 4,849,684, in which a current multiplier bandgap topology is described, has been employed.

Figure 6:
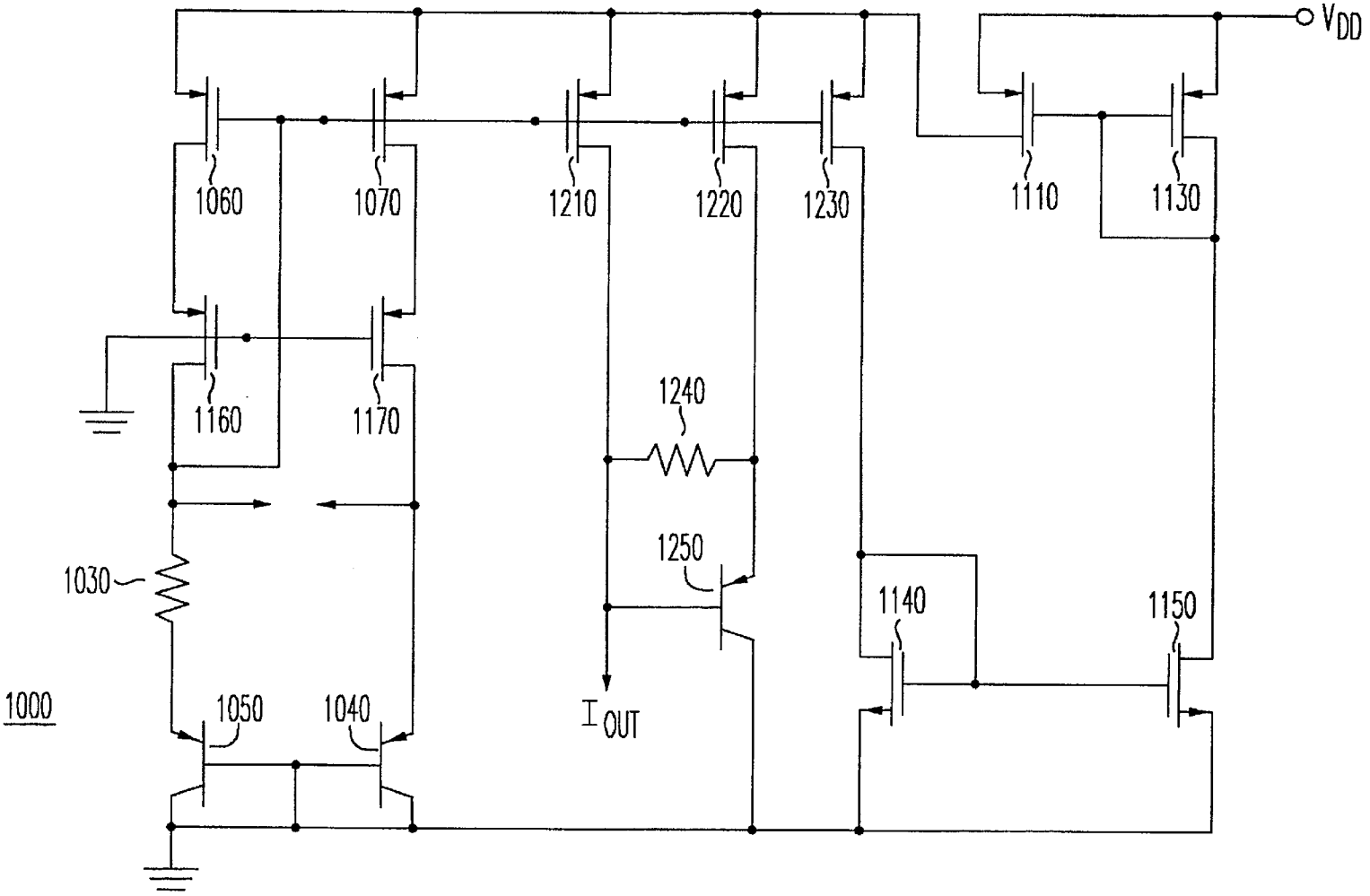
FIG. 6 is yet another embodiment of a PTAT current source in accordance with the invention.

FIG. 6 illustrates yet one more embodiment of a PTAT current source in accordance with the invention. This embodiment is formed by MOS devices 1210, 1220 and 1230, resistor 1240 and bipolar transistor 1250, although the invention is not restricted in scope in this respect. A substantially constant current provided at the emitter of bipolar transistor 1250 is substantially equal to the PTAT current offset by the base-to-emitter voltage of bipolar transistor 1250 divided by the resistance associated with load element 1240. Thus, as temperature increases, although the PTAT current increases, the base-to-emitter voltage of bipolar transistor 1250 declines or decreases. By selecting appropriate values for the PTAT current, the resistance associated with load element 1240, the emitter size of bipolar transistor 1250 and the current flowing through bipolar transistor 1250, which is affected at least in part by MOS device 1220, a constant current source substantially independent of temperature may be established.

Figure 7:
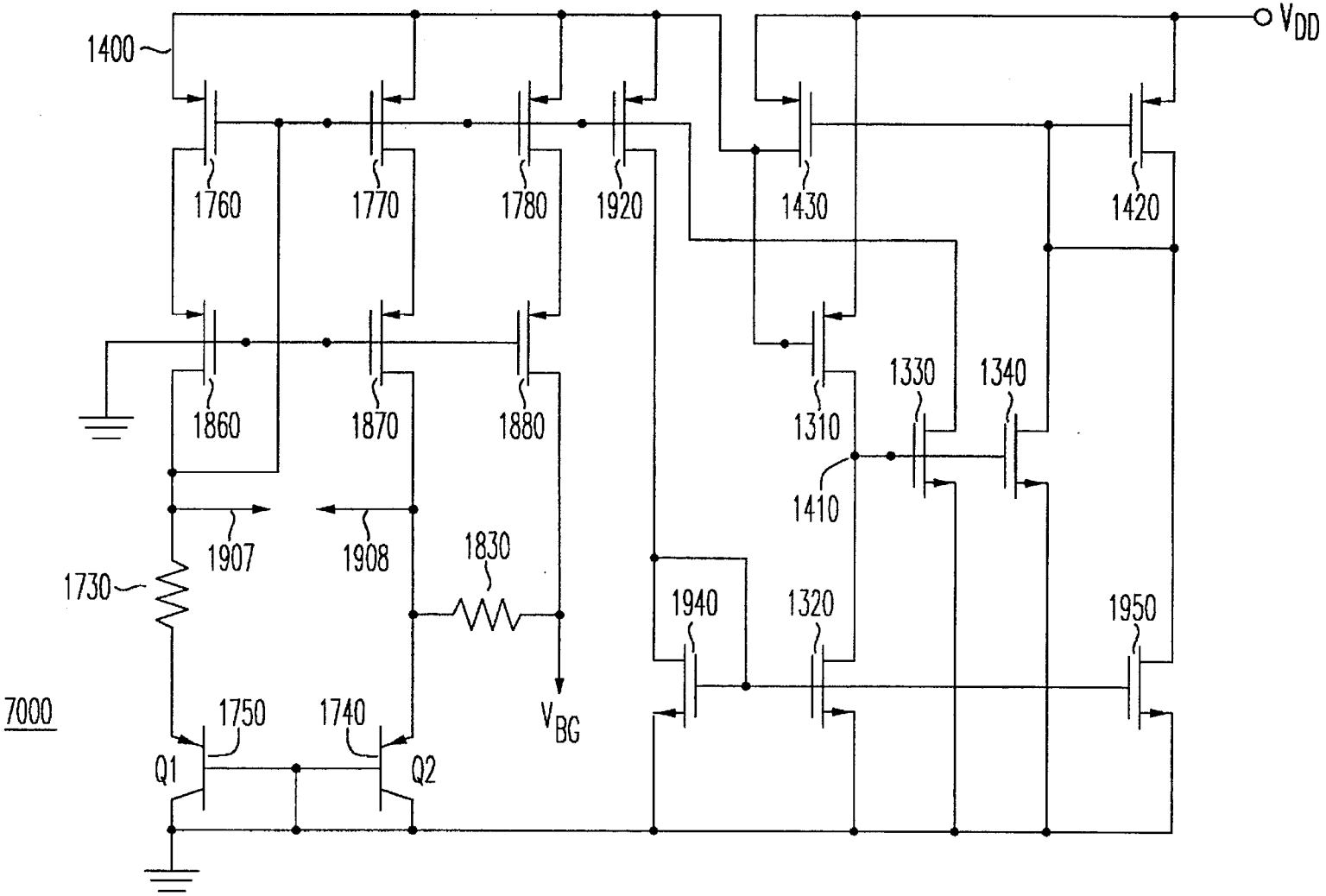
FIG. 7 is an embodiment of a start-up circuit for use with an embodiment of a PTAT current source in accordance with the invention, such as the embodiment illustrated in FIG. 5.

FIG. 7 illustrates an embodiment 7000 of a start-up circuit that may be employed in conjunction with a PTAT current source in accordance with the invention, for example, such as the embodiment illustrated in FIG. 5. A PTAT current source in accordance with the present invention, such as the embodiment illustrated in FIG. 5, may have multiple stable states of operation. In some of these stable operating states, the circuit may not obtain current from the current source supplying the circuit, such as current source 110 illustrated in FIG. 1. In other operating states, the circuit may generate undesired current levels or voltage levels. Thus, a start-up circuit may be employed to shift a circuit embodiment of a PTAT current source in accordance with the invention, such as the embodiment illustrated in FIG. 5, to the desired stable operating state.

FIG. 7 illustrates embodiment 7000 of a start-up circuit that may be employed, although the invention is not restricted in scope to this particular start-up circuit. As illustrated, start-up circuit 7000 comprises MOS devices 1310, 1320, 1330, and 1340. If the circuit is not in the correct state, node 1400, illustrated in FIG. 7, may be "low" and, thus, significant current should flow in MOS device 1310. As a result, node 1410 may be "high." Thus, MOS devices 1330 and 1340 should turn "on," resulting in current flow. MOS device 1340 will thus affect the operation of MOS device 1420, resulting in current flow. Likewise, current will flow as a result in MOS device 1430. This current flow in MOS device 1430 will cause node 1400 to raise in voltage resulting in current flow in the operational amplifier (not shown) coupled between nodes 1907 and 1908. MOS device 1330 will cause current to flow in MOS devices 1760 and 1860. This will cause current to flow in MOS devices 1770, 1780, and 1920. Ultimately, this operation will result in a flow of current in the first current path, and the second current path, as desired. Once the circuit moves to this desired operating state as a result of the voltage at node 1400, MOS transistor 1310 will turn "off," as will MOS devices 1330 and 1340, and the start-up circuit will no longer affect operation of the circuit embodiment of a PTAT current source in accordance with the invention.

A PTAT current source in accordance with the invention may be operated in accordance with the following method. A current substantially proportional at an absolute temperature may be supplied in an electrical circuit or on an integrated circuit, such as the integrated circuit illustrated in FIG. 1. The current substantially proportional to absolute temperature is provided in a manner so that it may be utilized by circuitry external to the PTAT current source itself. Thus, an integrated circuit or electrical circuit may include, as previously described, a first current path and a second current path, such as, for example, illustrated by the embodiment of a PTAT current source in accordance with the invention shown in FIG. 1. As illustrated in FIG. 1, the respective current paths are coupled so as to provide first and second currents through the current paths, at least during electrical or integrated circuit operation, so that the first current and the second current are in a substantially predetermined direct proportion. Typically, this may be accomplished by a current mirror, as previously described. The first current path and the second current path each respectively has a predetermined point along the respective paths having a voltage. In fact, any one of a number of points along the respective current paths will suffice. Of course, the voltages at these two predetermined points along the respective paths are defined relative to an absolute voltage level, such as ground. In each current path, the voltage at the predetermined point along the path is related to the current flowing through the path substantially in accordance with the junction diode equation, as previously described. This may be accomplished using, for example, bipolar transistors, such as illustrated in FIG. 1, using diodes, or, alternatively, using MOS devices operating in the subthreshold region, as previously described. The voltages at the respective points along the respective current paths are compared. As previously described, this may be accomplished using an operational amplifier, such as operational amplifier 120 illustrated in FIG. 1. Of course, the scope of the invention is not restricted to a particular type of operational amplifier. For example, as previously described, a cascode folded operational amplifier may be employed. The operational amplifier compares the voltages at the respective points along the respective current paths and applies a voltage to the first current path and the second current path based at least in part on the voltage comparison. Through this technique, as previously described, the operational amplifier provides feedback to ensure that the voltages at the respective points along the respective current paths are substantially equal. As previously described, one advantage of using an operational amplifier in this configuration is that the voltages at the respective points along the respective current paths may be made substantially equal with potentially only one offset error attributable to possible imperfections in the operation of the operational amplifier. Thus, as previously described, by supplying currents through respective current paths in a substantially predetermined direct proportion using a current mirror, maintaining substantially equal voltages at two respective predetermined points along the two respective current paths, and ensuring that the relationship between the voltages and the currents in the first and second paths are maintained substantially in accordance with the junction diode equation provides a method of circuit operation in accordance with the invention in which a current substantially proportional to absolute temperature is supplied for use by other circuitry.

While only certain features of the invention have been illustrated and described herein, many modifications, substitutions, changes or equivalents will now occur to those skilled in the art. It is, therefore, to be understood that the appended claims are intended to cover all such modifications and changes that fall within the true spirit of the invention.

We claim:

1. A current source that supplies a current substantially proportional to absolute temperature for use in an integrated circuit comprising:

a first current path and a second current path driven by a fixed current source;

said current paths being coupled so as to provide a first current and a second current flowing through the respective current paths at least during circuit operation, said first current and said second current being in a substantially predetermined direct proportion; and an operational amplifier including respective input terminals respectively coupled to said first current path and said second current path, said operational amplifier being coupled in a feedback configuration so as to maintain substantially equal first and second voltages between a first substantially predetermined point and a second substantially predetermined point respectively located along said first current path and said second current path;

the respective first and second currents being related to the respective first and second voltages substantially in accordance with a junction diode equation.

2. The current source of claim 1, wherein a current mirror is coupled to the respective current paths so as to substantially maintain said first current and said second current in a substantially predetermined direct proportion.

3. The current source of claim 2, wherein said current mirror is formed from at least two standard MOS devices.

4. The current source of claim 3, wherein said integrated circuit comprises an integrated circuit processed in accordance with a standard MOS integrated circuit fabrication process.

5. The current source of claim 2, wherein the respective current paths are coupled to a low voltage power supply.

6. The current source of claim 5, wherein said low voltage power supply comprises a power supply below 2 volts.

7. The current source of claim 2, wherein a first bipolar transistor and a second bipolar transistor are respectively coupled to said first current path and said second current path in a configuration so that said first current and said second current through the respective current paths are related to the respective first and second voltages substantially in accordance with the junction diode equation.

8. The current source of claim 2, wherein said current source is coupled in a circuit configuration further including a load element and a bipolar transistor so as to provide a bandgap voltage reference generator.

9. The current source of claim 2, and further comprising a start-up circuit coupled to said current source.

10. The current source of claim 2, wherein said operational amplifier comprises a folded-cascode operational amplifier.

11. The current source of claim 10, wherein the current source constitutes a PTAT current source, said operational amplifier being adapted to be powered by an external current source, the external current source being adapted to supply current to said operational amplifier developed at least in part from the current supplied by said PTAT current source.

12. A current source supplying a current substantially proportional to absolute temperature, said current source comprising:

a first current path and a second current path;

said first path including a first semiconductor device;

said second path including a second semiconductor device;

said first current path and said second current path being coupled to a current mirror so as to respectively maintain a first current in said first current path and a second current in said second current path, said currents being in a substantially predetermined direct proportion;

and an operational amplifier including two input terminals respectively coupled to a first predetermined point and a second predetermined point respectively located along said first current path and said second current path between said current mirror and said semiconductor devices, said operational amplifier being coupled in a feedback configuration so as to maintain substantially equal voltages between said first and second predetermined points, wherein said first semiconductor device is a first bipolar transistor coupled by an emitter through a resistor to said operational amplifier and said second semiconductor device is a second bipolar transistor coupled by an emitter to said operational amplifier, wherein bases and collectors of said first bipolar transistor and said second bipolar transistor are mutually connected.

13. The current source of claim 12, wherein the last-recited current source constitutes a PTAT current source, said operational amplifier being adapted to be powered by an external current source, the external current source being adapted to supply current to said operational amplifier developed at least in part from the current supplied by said PTAT current source.

14. A method of supplying a current substantially proportional to absolute temperature on an integrated circuit;

said integrated circuit including a first current path and a second current path;

said current paths being coupled to a current mirror so as to respectively maintain first and second currents through the respective current paths at least during integrated circuit operation, said first current and said second current being in a substantially predetermined direct proportion;

said first current path and said second current path respectively having a substantially predetermined point located along the respective current paths, each of the predetermined points having a voltage;

in each current path, the voltage at the predetermined point along the current path being related to the current through the current path substantially in accordance with a junction diode equation;

said method comprising the steps of:

driving said first current path and said second current path using a fixed current source;

comparing the voltages at the respective predetermined points along the respective current paths; and applying a voltage to the respective paths, at least in part in accordance with the voltage comparison.

15. The method of claim 14, wherein the step of comparing the voltages at the respective predetermined points along the respective current paths comprises applying the voltages to the input terminals of an operational amplifier; and the step of applying a voltage comprises applying the output voltage of said operational amplifier to the respective current paths.

16. The current source of claim 1, wherein the junction diode equation determines a relationship between a current through a semiconductor device and a voltage across the device that satisfies:

$$I = I_o(e^{V/nV_T} - 1)$$

where I is the device current, V is the device voltage, $I_o$ is a reverse saturation current, $V_T$ is a thermal voltage, and n is a constant related to properties of the semiconductor material employed.

* * * * *